US005197625A

United States Patent [19]

Mullaney

[11] Patent Number: 5,197,625

[45] Date of Patent: Mar. 30, 1993

[54] CARTON

[75] Inventor: Ronald F. Mullaney, Pennington, N.J.

[73] Assignee: American Packaging Corporation, Philadelphia, Pa.

[21] Appl. No.: 715,901

[22] Filed: Jun. 14, 1991

[51] Int. Cl.[5] ..... B65D 5/54; B65D 5/56

[52] U.S. Cl. ..... 220/418; 220/462; 229/162; 229/240

[58] Field of Search ..... 220/416, 418, 462; 206/45.31; 229/215, 240, 243, 162

[56] References Cited

U.S. PATENT DOCUMENTS

| | | | |
|---|---|---|---|
| 1,752,504 | 4/1930 | Penrose | 206/45.31 |
| 1,847,301 | 3/1932 | Elliott | 206/45.31 |
| 2,031,111 | 2/1936 | Kondolf | 206/45.31 |
| 2,107,613 | 2/1938 | Kotcher et al. | 229/162 |
| 2,153,911 | 4/1939 | Benedetti | 229/162 |
| 2,177,918 | 10/1939 | Vogt et al. | 206/45.31 |
| 2,214,944 | 9/1940 | Vogt | 229/162 |
| 2,241,710 | 5/1941 | Lowey | 206/45.31 |
| 2,242,711 | 5/1941 | Olivier | 206/45.31 |
| 2,294,473 | 9/1942 | Makeley | 229/162 |
| 2,819,000 | 1/1958 | Boguss et al. | 229/160.1 |
| 2,944,727 | 7/1960 | Moore | 229/162 |
| 3,092,245 | 6/1963 | Poisson | 206/45.31 |
| 3,190,440 | 6/1965 | Palmer | 229/162 |
| 3,207,411 | 9/1965 | Farquhar | 206/45.31 |
| 3,322,265 | 5/1967 | Collura | 206/45.31 |
| 3,490,678 | 1/1970 | James et al. | 206/45.31 |
| 3,640,447 | 2/1972 | Forbes, Jr. et al. | 206/45.31 |
| 3,690,523 | 9/1972 | Link | 206/45.31 |
| 4,565,315 | 1/1986 | Wagner et al. | 220/416 |
| 4,838,424 | 6/1989 | Petzelt | 220/462 |
| 5,009,518 | 4/1991 | Faltynek | 206/45.31 |
| 5,048,691 | 9/1991 | Heuberger et al. | 220/462 |

FOREIGN PATENT DOCUMENTS

| | | | |
|---|---|---|---|
| 934095 | 10/1955 | Fed. Rep. of Germany | 206/45.31 |
| 763770 | 12/1956 | United Kingdom | 206/45.31 |

*Primary Examiner*—Gary E. Elkins
*Attorney, Agent, or Firm*—Frank A. Follmer

[57] ABSTRACT

A lined container is provided with a transparent liner and a pair of tear strips in an endwall of an outer carton removable to provide windows extending along the vertical extent of the endwall. The level of the contents of the carton is visible through the windows and the transparent liner.

6 Claims, 10 Drawing Sheets

FIG. 4A
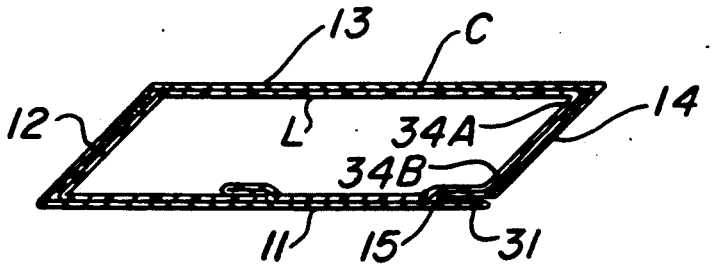
FIG. 16
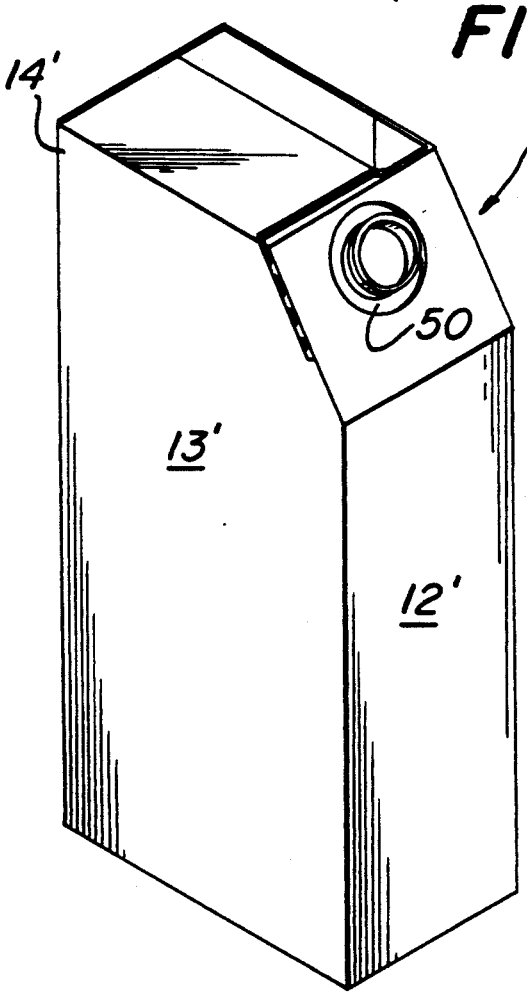
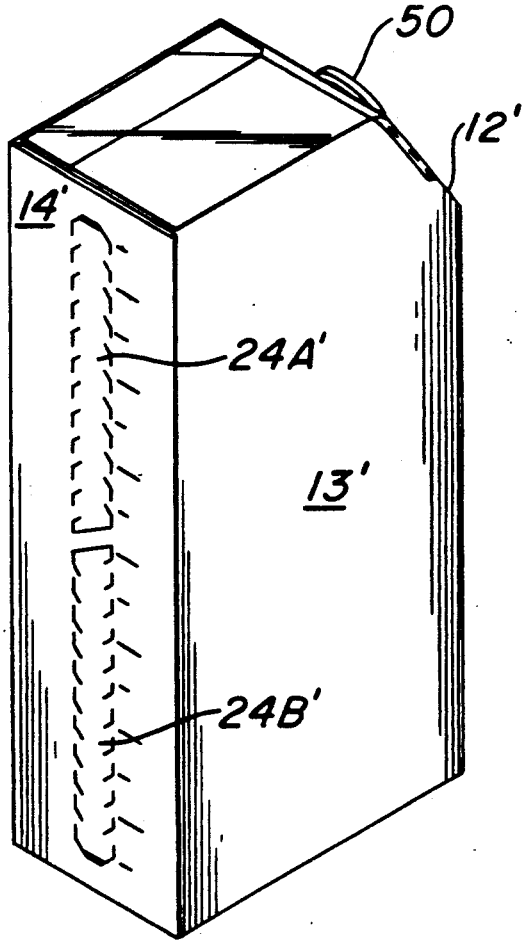
FIG.17

FIG. 10
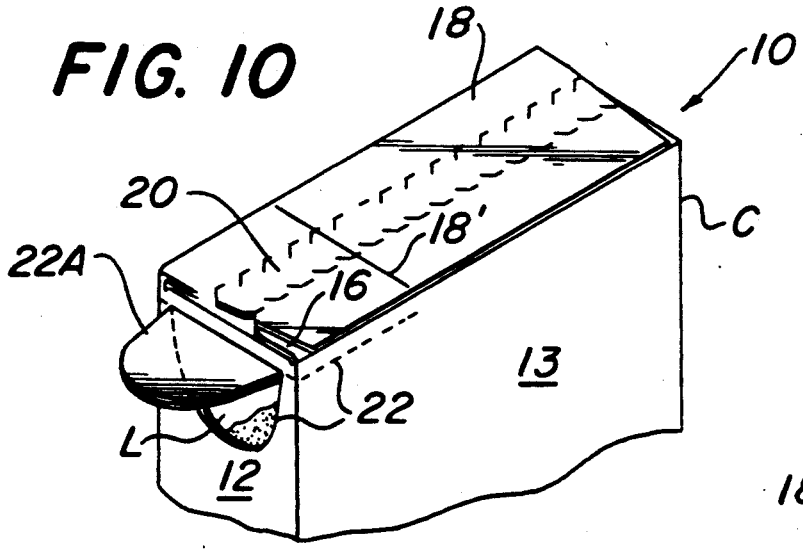
FIG. 11
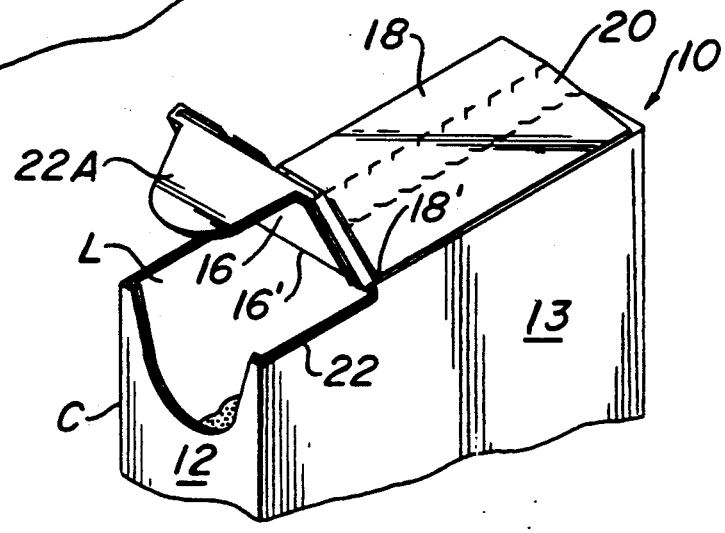
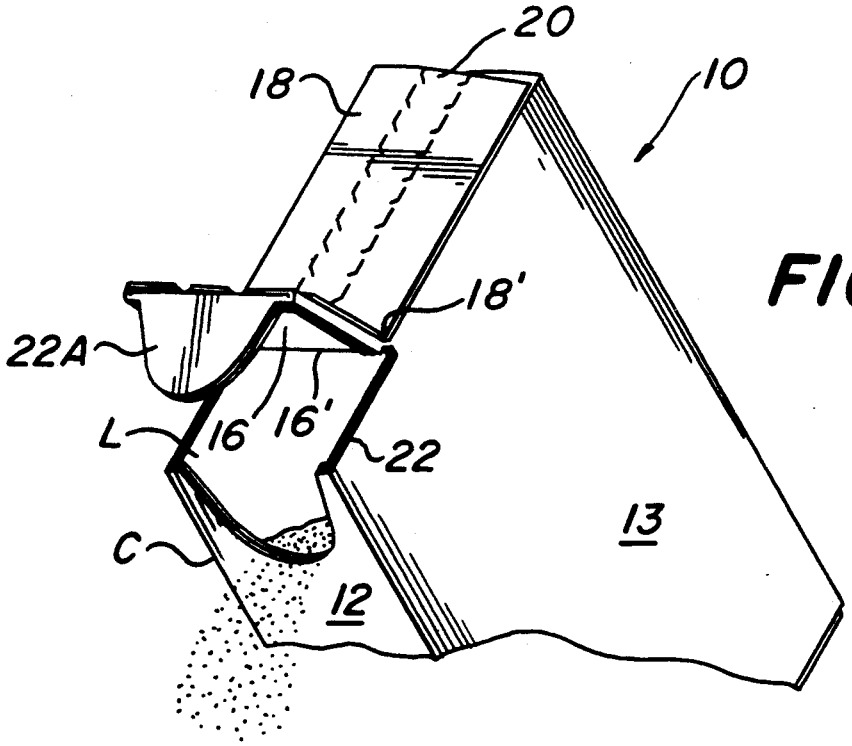
FIG. 12

CARTON

BACKGROUND OF THE INVENTION

1. Field of the Invention

This invention relates generally to the field of carton-type containers of the paperboard or boxboard type provided with liners. The invention also relates to carton structures and methods for making a carton of the indicated type.

2. Description of the Prior Art

Cartons of the indicated type and methods of making the same are known in the art and are described in U.S. Pat. Nos. 2,099,257, 2,166,389, 4,032,060, 4,099,665, 4,236,368 and 4,838,424.

The prior art cartons are also provided with means for dispensing the product contained therein, such as pour spouts or the like, and with windows through which the user of the carton can, during use, view the amount of the product contained within the carton. Cartons of this type are disclosed in U.S. Pat. Nos. 2,177,918, 2,819,000, 3,746,240 and 4,572,422.

SUMMARY OF THE INVENTION

It is the general object of the invention to provide a lined carton of the indicated type which comprises means whereby during use, it is possible to determine with ease and accuracy the amount of product contained in the carton. Briefly stated, such means comprises an interior liner made of a light transmitting (transparent or translucent) material and an outer carton comprising novel means to provide a window extending along the vertical extent thereof through which the interior of the carton can be viewed through a portion of the liner extending across the window so that the amount of the product contained therein can be determined.

In accordance with another object of the invention there is provided a carton structure for use in forming a carton of the indicated type.

In accordance with another object of the invention there is provided a method of forming a carton of the indicated type.

More specifically, the novel window providing means of the invention comprises a pair of tear strips adapted to be removable to provide a pair of windows in an endwall of the outer carton, said windows extending along the vertical extent of the endwall whereby the interior of the outer carton can be viewed through a seethrough liner to determine the level of the product contained therein. The tear strip construction maintains the strength of the carton to support the product contained therein until the time the tear strips are removed to provide the windows. Furthermore, the tear strips can be removed progressively to coordinate with the depletion of the product contained within the carton whereby the strength of the carton can be maintained so long as necessary to confine the carton contents. In accordance with another feature of the window construction, the liner is adhered to the inner surface of the endwall of the outer carton provided with the tear strips in a manner to hold the liner in a position extending across and adjacent to the windows that are formed by the tear strips to thereby enhance the visibility of the level of the contents of the carton.

BRIEF DESCRIPTION OF THE DRAWINGS

FIGS. 4 and 4A are plan and section views illustrating the carton blank in a flat-folded tubular condition.

FIGS. 10, 11 and 12 are views illustrating the manner in which the carton is used to dispense the product contained therein when a thumb notch is used to open the top of the carton.

FIGS. 16 and 17 are perspective views showing the application of the invention to a container provided with a pour spout.

DETAILED DESCRIPTION OF THE PREFERRED EMBODIMENT

Figure 1:
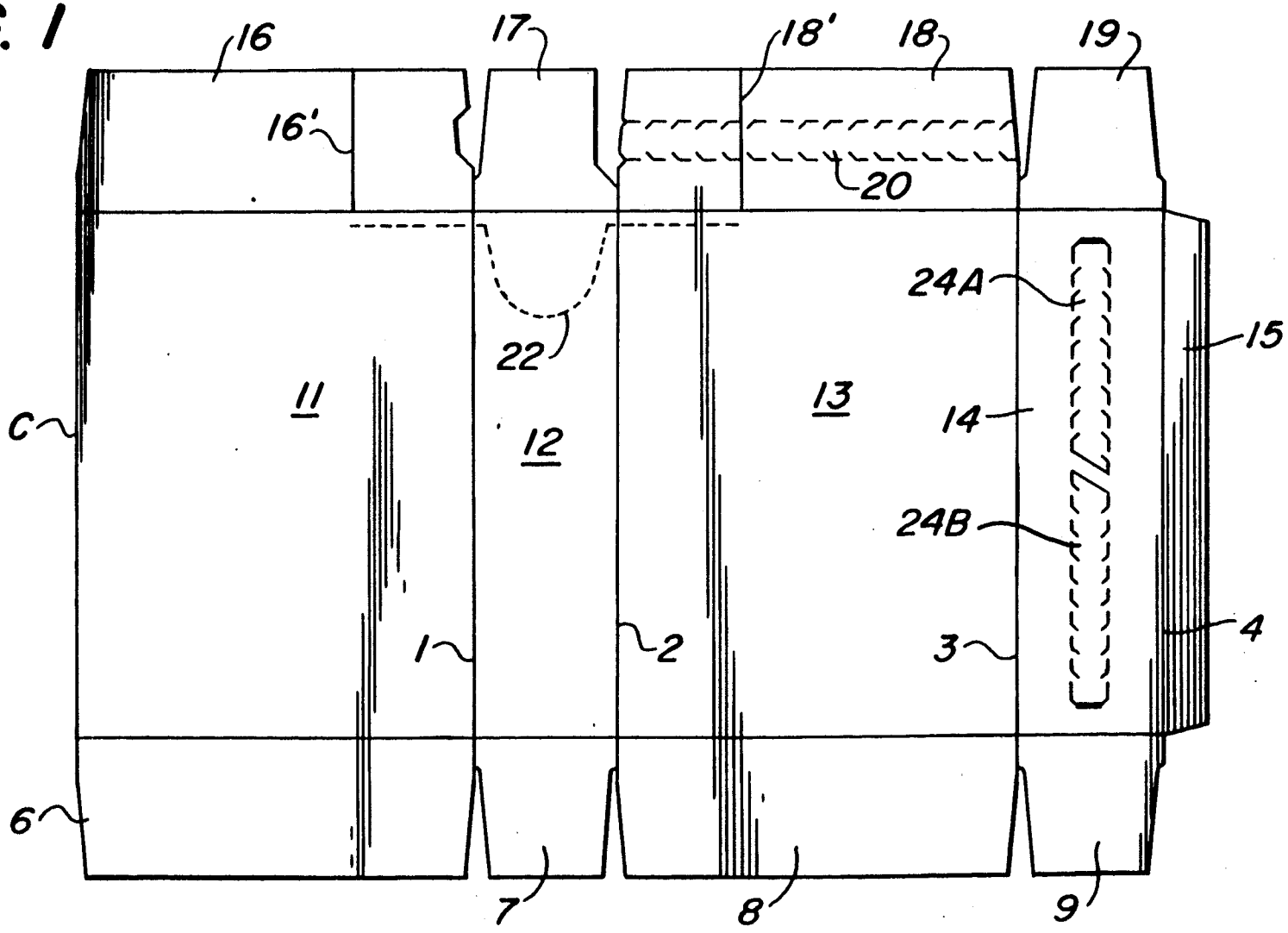
FIG. 1 is a plan view of a carton blank for use in making a carton in accordance with the invention.

The carton-type of container in accordance with the invention is illustrated generally at 10 and comprises an outer carton C and an inner liner L. The outer carton C is made from a carton blank as shown in FIG. 1 and comprises a sheet of suitable paperboard or boxboard cut and scored as shown in this figure. The blank is provided with four scores 1, 2, 3, 4 formed to extend along parallel lines to define a plurality of panels, including a sidewall 11, an endwall 12, sidewall 13 and an endwall 14, respectively, with an attachment flap 15 hingedly connected to the outermost side edge of endwall 14 adjacent the score 4, as is shown in FIG. 1. Panels 11, 12, 13 and 14 are provided with conventional bottom end closure flaps 6, 7, 8 and 9, respectively, hingedly connected along the bottom end thereof for forming the bottom closure of a conventional carton bottom as will be described hereafter. Panels 11, 12, 13 and 14 are also provided with top end closure flaps 16, 17, 18 and 19, respectively, at their top ends, said closure flaps 16–19 being constructed and arranged to form the top closure of the carton in a conventional manner as will be described hereafter.

Top end closure flap 18 is provided with a conventional tear strip 20 for use in opening the carton as will be described more fully hereafter.

Outer carton C is provided with means for forming a pour spout at the top end thereof, such means comprising a thumb notch arrangement of die cuts 22 located in panels 11, 12 and 13 and score lines 16' and 18' in top flaps 16 and 18, respectively. Endwall 14 has a pair of tear strips 24A and 24B adapted to provide a pair of centrally located windows extending along the vertical extent thereof through which the interior of a formed carton can be viewed. Tear strips 24A and 24B are provided by conventional cut scores formed in endwall 14.

The blank shown in FIG. 1 can be readily fabricated into a knocked-down tubular condition in accordance with conventional practice.

Figure 2:
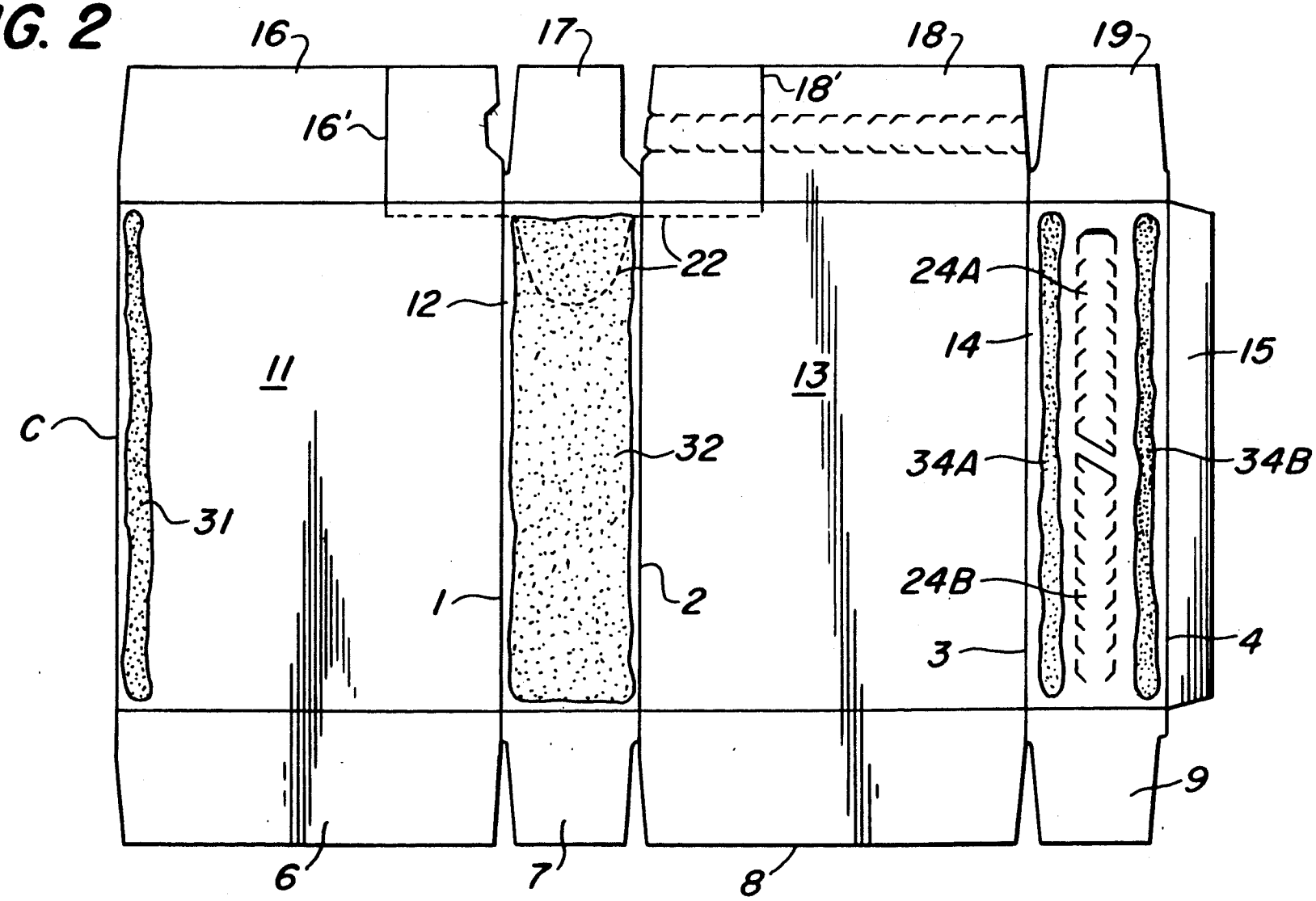
FIG. 2 is a plan view similar to FIG. 1 illustrating the carton blank in a subsequent step in the method of forming the carton.

In the next step of forming a carton in accordance with the invention, utilizing conventional carton folding and gluing equipment, the carton blank shown in FIG. 1 is fed out of a hopper by timed feed pads into a register section from which the carton blank is fed into a prebreak section, as illustrated in FIG. 2, where adhesive is applied to the carton blank by timed glue pads. At this section, strips of adhesive are applied to the upper surfaces of the panels 11, 12 and 14 as is shown in FIG. 2. These adhesive strips are utilized for securing the outer carton C and the inner liner L together in a registered condition and for interconnecting the carton blank in its tubular condition. Thus, as shown in FIG. 2, the upper surface of the carton blank has applied thereto a strip of adhesive 31 which is applied to panel 11 to extend along the outer edge thereof. Also, a wide strip of adhesive 32 is applied to the endwall 12 to cover most of its surface area. Also, a pair of spaced apart parallel strips of adhesive 34A and 34B are provided on panel 14 to extend on opposite sides of the two pairs of tear strips 24A and 24B formed thereon in an arrangement as viewed in FIG. 2.

Figure 3:
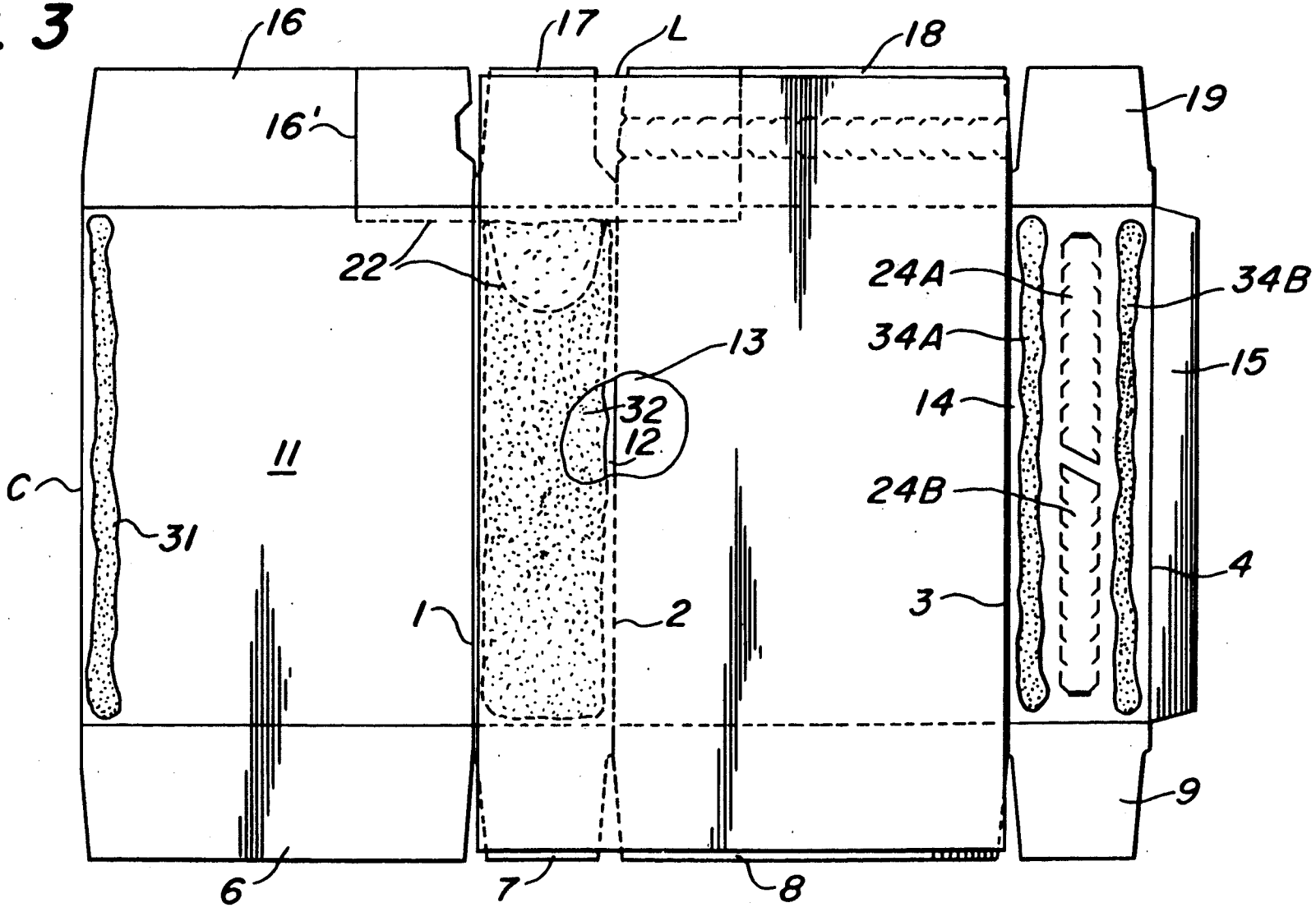
FIG. 3 is a plan view of the carton blank shown in FIG. 1 illustrating the positioning of a flat-folded tubular liner on the carton blank.

In the next step of the method of making the carton, the carton blank is fed to a folding section illustrated in FIG. 3, whereat a liner L, which is made of a transparent, moisture/vapor-proof material and which has been formed, sealed and cut off by a knife to form a flat-folded tube, meets the carton blank and is registered thereon. Utilizing conventional equipment, the carton blank and the liner L meet at a nip point prior to going into the folding section whereupon they are pulled through with a top and bottom center carrier just prior to the folding step. As the carton blank containing the liner L moves into the folding section and at a location prior to folding, the carton structure will be in a condition as shown in FIG. 3 with the liner L deposited on the blank in the manner shown.

In the next step in the method of making the carton in accordance with the invention, i.e., the folding step, the carton blank is moved through a folding section where the carton blank is folded on score lines 1 and 3. In this folding step, initially endwall 14 and attachment flap 15 will be folded together along score 3 to overlie the adjoining side of the liner L, which movement is followed by the infolding of sidewall 11 along score 1 on the opposite side of the carton blank thereby bringing the carton blank to the flat-folded condition illustrated in FIG. 4. During these folding steps, the strip of adhesive 31 will be interposed between the outermost side edge of panel 11 and the surface of attachment flap 15 contacted thereby. Also, liner L is attached in a registered position on the outer carton C by the adhesive strips 32, 34A and 34B. It will be noted that the wide adhesive strip 32 holds the liner L against almost the entire surface of endwall 12 and the two strips of adhesive 34A and 34B hold a portion of the liner L against the endwall 14 so as to extend closely to and overlie the portion of the endwall 14 having tear strips 24A and 24B formed therein.

Figure 4:
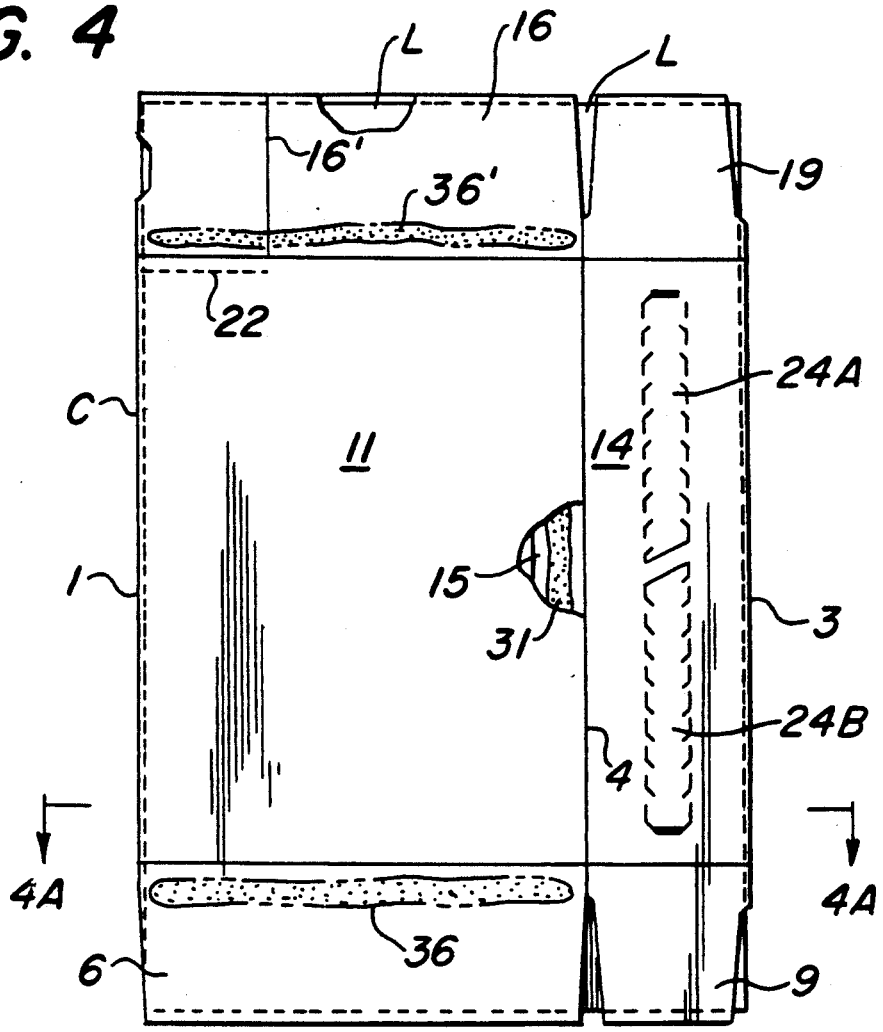

After the carton blank is folded to the condition shown in FIG. 4, it is passed into a compression apron whereby pressure is applied to secure the liner L to the carton blank throughout the overlapping surfaces thereof where the adhesive is applied. Thus, the liner L adheres to the opposing surfaces of sidewalls 12 and 14 at the glue strips 32, 34A and 34B.

It will be apparent that the flat-folded carton blanks shown in FIG. 4 are in condition to be shipped and stored in a flattened condition as shown in this figure. In the hands of the packager, the carton blanks can be readily erected by simply squaring up the carton body walls, the carton walls being moved to positions in which the adjacent walls lie at right angles to one another, such movement serving to automatically erect the tubular liner L as well.

The packager will complete the formation of the carton in accordance with the invention by adding the product and by closing the carton. In the formation of the carton by the packager, the bottom end of the carton is sealed first. In this procedure, the carton is inverted and the bottom end of the liner L flattened and sealed in a conventional fashion, followed by the infolding of the liner L and a concurrent infolding and securing together of the bottom closure flaps 6–9, as will be readily understood by those skilled in the art. In this procedure, the bottom flap 6 is provided with a strip of adhesive 36 (as shown in FIG. 4) which is used to adhesively secure the bottom structure together. Various types of folding and gluing apparatus are available to form the necessary liner sealing, flap folding and gluing operations.

Figure 7:
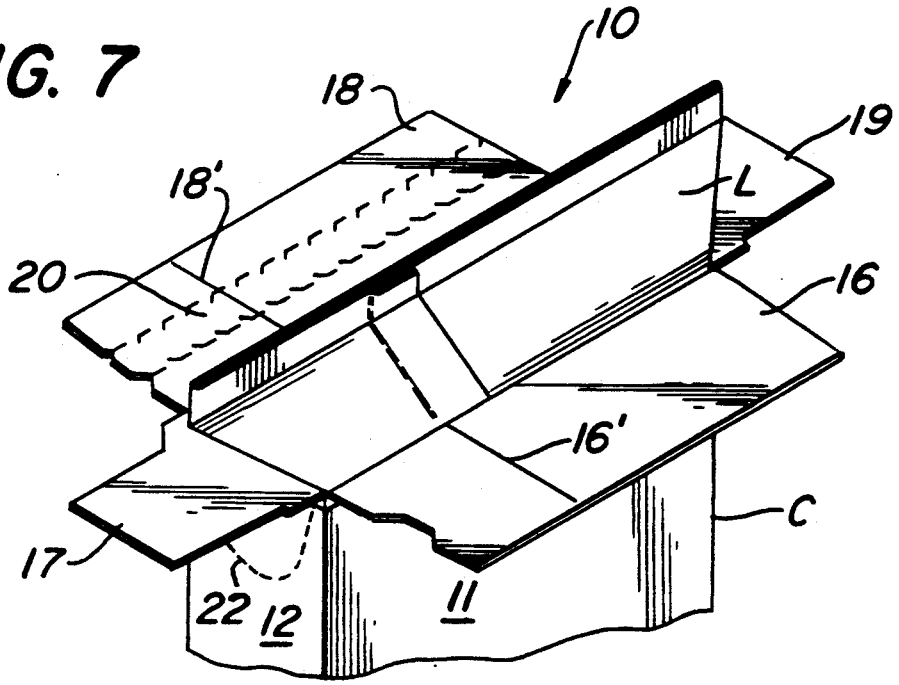
FIGS. 6 and 7 are perspective views illustrating the carton in an initially erected condition during the formation of a completed carton.
Figure 5:
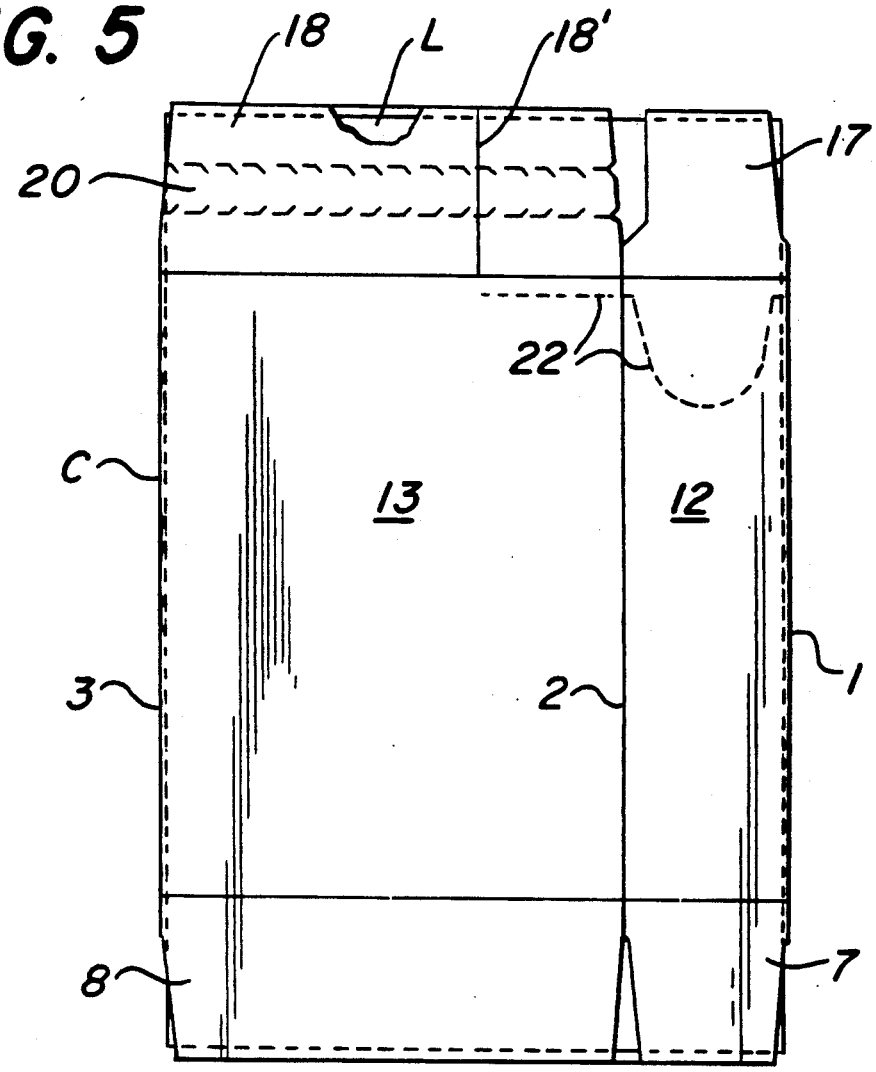
FIG. 5 is a view similar to FIG. 4 showing the other side of the carton blank in its flat-folded tubular condition.
Figure 8:
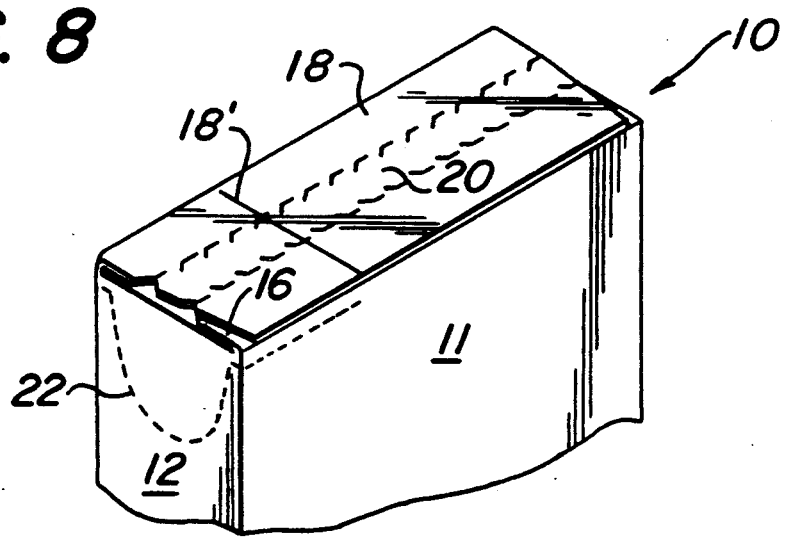
FIGS. 8 and 9 are perspective views showing a completed carton in accordance with the invention.
Figure 6:
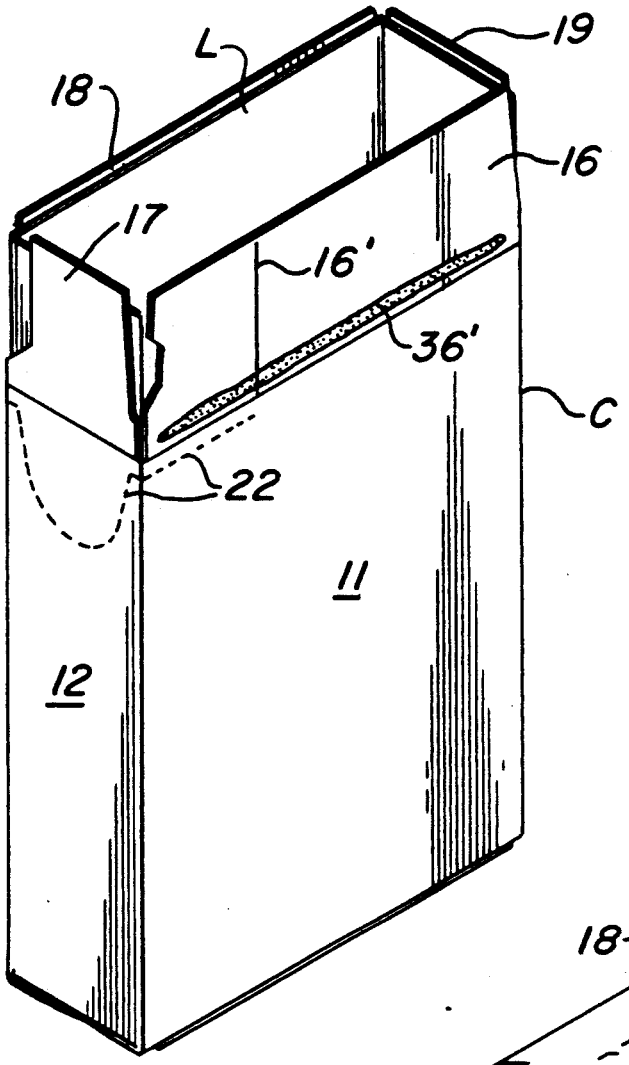
Figure 9:
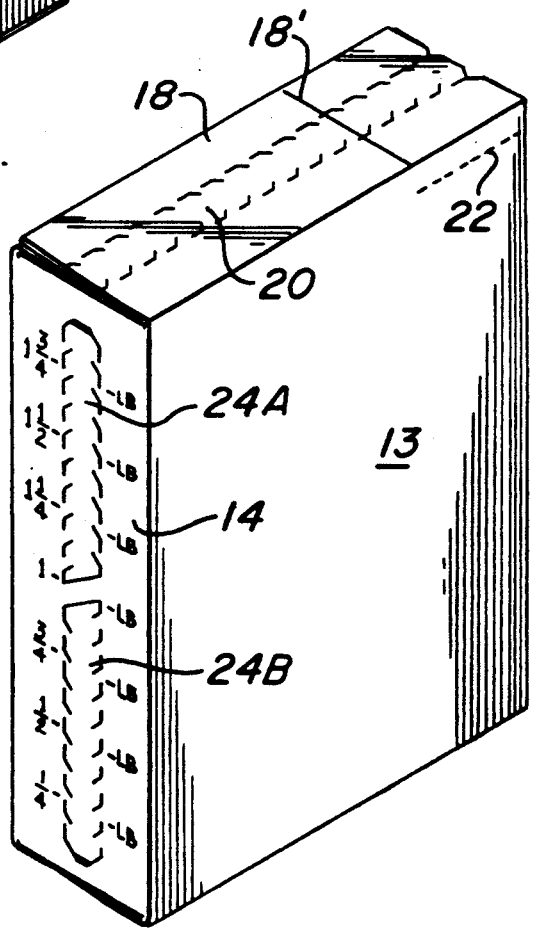

Following formation of the bottom end closure, the carton will be inverted to a position as shown in FIG. 6 and filled with the desired contents, whereupon the uprighted and filled carton will be advanced to a sealing station where the top end of liner L is sealed as shown in FIG. 7. Next, liner L is infolded and top closure flaps 16–19 are infolded and secured in a closed condition. The top closure is also effected in a conventional manner by equipment available in the art to form a carton closed at the top as illustrated in FIGS. 8 and 9. In this step, top flap 16 is provided with a strip of adhesive 36' which is used to secure the top closure structure together.

The sealing of the liner L and the closure of the top of the carton are achieved by conventional equipment known in the art, such as those described in patents referred to above.

As shown in FIGS. 8 and 9, the carton 10 in accordance with the invention comprises window providing means in the form of the removable tear strips 24A and 24B, which, when removed, provide a pair of windows in endwall 14. These windows extend along the vertical extent of endwall 14 whereby the interior of the outer carton C can be viewed through the transparent liner L to determine the level of the product contained in the carton. As shown in FIG. 9, endwall 14 has printed thereon indicia extending along the tear strips 24A and 24B providing a graduated scale which can be used to indicate the amount of product contained within the carton as viewed through the windows and the transparent liner L. In accordance with another feature of the window construction, the liner L is adhered (by means of adhesive strips 34A and 34B) to the inner surface of endwall 14 in a manner to hold the liner L in a position extending across and adjacent to the windows that are formed by the removal of tear strips 24A and 24B to thereby enhance the visibility of the level of the contents of the carton. Also, liner L is adhered to the inner surface of the endwall 12 opposite endwall 14 throughout the surface thereof (by means of adhesive area 32) so as to maintain the liner L in contact with endwall 12 during the use of the carton. By this construction, the liner L is maintained in a spaced-apart condition within outer carton C during use whereby the accuracy of the reading of the level of the contents in the carton 10 will be ensured because the liner cannot shift relative to the outer carton C during use.

Figure 13:
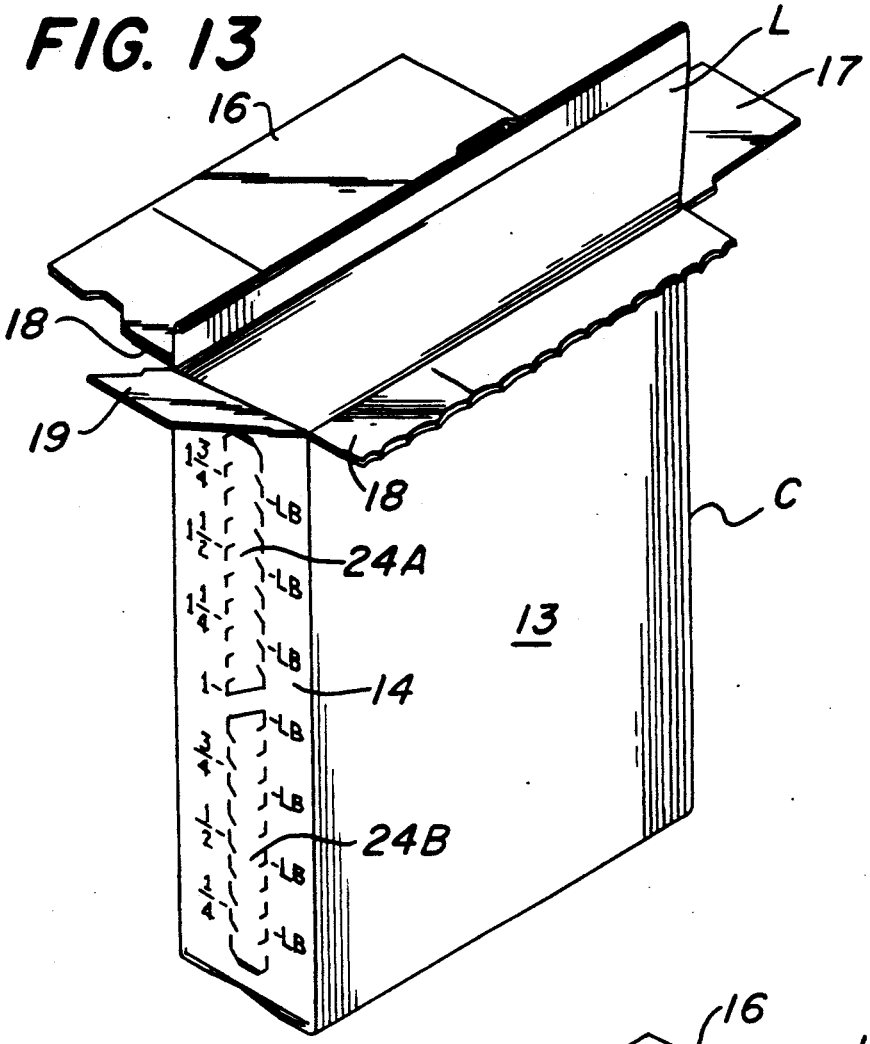
FIGS. 13 and 14 are views illustrating the manner the carton is used to dispense the product contained therein when a top tear strip is used to open the top of the carton.
Figure 14:
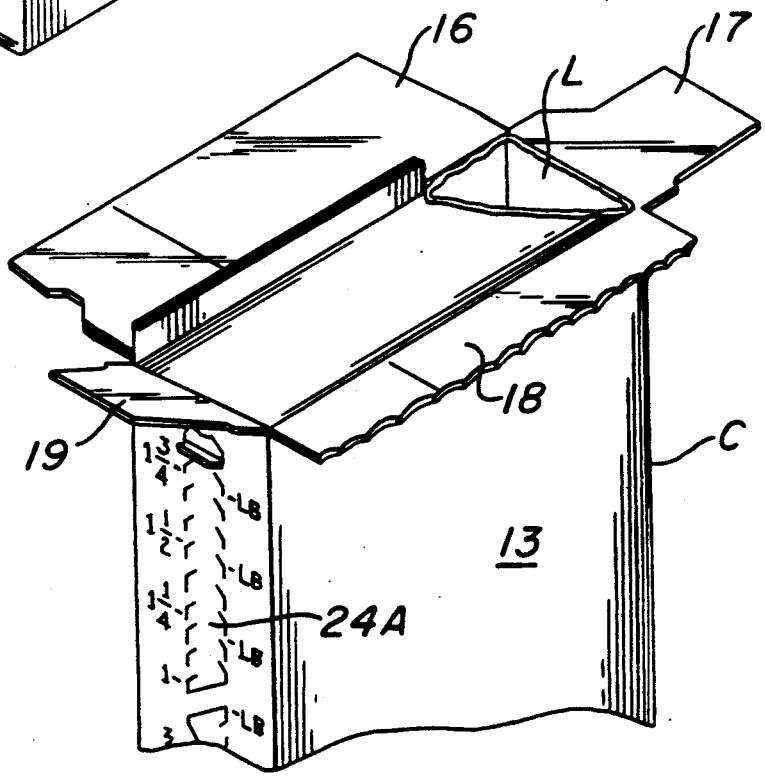

It will be noted that the carton 10 shown in FIGS. 8 and 9 is provided with two means for opening the top of the carton to dispense the contents thereof. Thus, the thumb notch 22 can be removed to open the top of the carton 10 in the manner shown in FIGS. 10 to 12, and the tear strip 20 can be removed to open the top of the carton in the manner as shown in FIGS. 13 and 14. This construction gives the user the option of using either one of the top opening means depending on the type of contents in the carton 10 and the use to which it will be put.

Referring to FIGS. 10, 11 and 12, the first step in opening the top of the carton 10 is to remove the curved portion 22A of the thumb notch 22 from the endwall 12 to the position as shown in FIG. 10. The top portion of the carton 10 is then torn back along the straight cut scores of thumb notch 22 in sidewalls 11 and 13 and bent up along the score lines 16' and 18' of the top flaps 16 and 18 to place the carton in the condition shown in FIG. 11. After the top flaps of the outer carton C are bent back, the liner L is torn open along the top portion thereof as shown in FIG. 11. FIG. 12 illustrates the manner in which the contents of the carton 10 can be dispensed through the opening formed in the top end thereof.

FIGS. 13 and 14 illustrate the manner in which the top of the carton 10 is opened by use of the top tear strip 20. The first step is to remove the tear strip 20 to divide top flap 18 into two parts and to bend back the top flaps 16 to 19 to the position shown in FIG. 13 providing access to the top end of the liner L. The next step is to tear an opening in one end of the liner L at the top end thereof as shown in FIG. 14. This opening then can be used to dispense the contents of the carton 10 as desired.

Figure 15A:
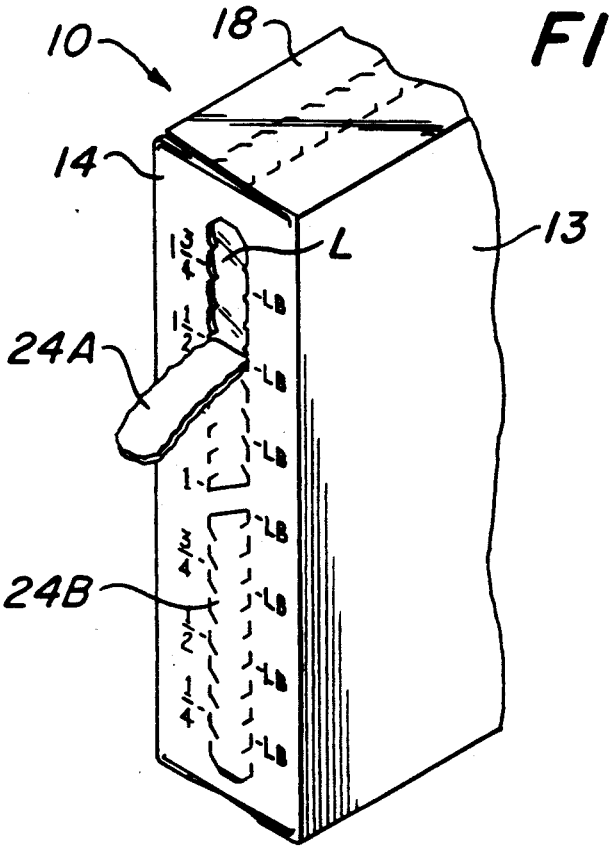
FIGS. 15A–C are views showing the use of the tear strips to form windows in an endwall of the carton.
Figure 15B:
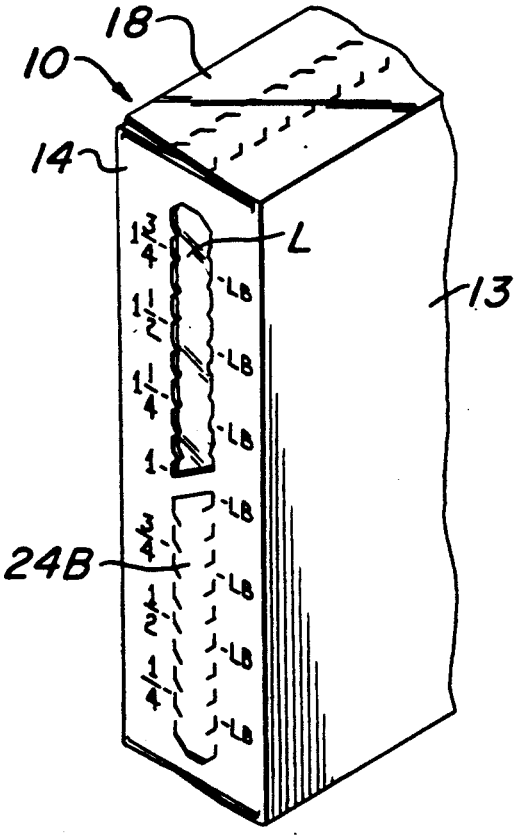
Figure 15C:
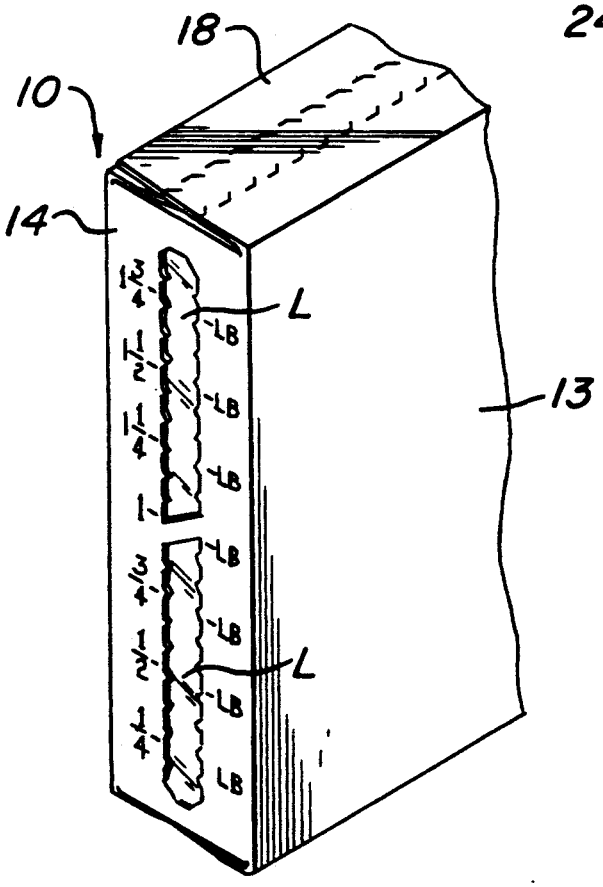

It will be apparent that the tear strip construction in accordance with the invention maintains the strength of the carton 10 to support the product contained therein until the time the tear strips 24A and 24B are removed to provide the windows. Furthermore, the tear strips 24A and 24B can be removed progressively to coordinate with the depletion of the product contained within the carton 10 whereby the strength of the carton 10 can be maintained so long as necessary to confine the carton contents. Thus, as shown in FIG. 15A the user can remove only part of the upper tear strip 24A initially and then subsequently, as shown in FIG. 15B, remove the entire upper tear strip 24A and ultimately, as shown in FIG. 15c both tear strips 24A and 24B can be removed.

FIGS. 16 and 17 illustrate a carton 10' provided with a pair of tear strips 24A' and 24B' in an endwall 14' and incorporating the tear strip design in accordance with the invention. The carton shown in FIGS. 16 and 17 employs a pour spout 50 at the upper end of the endwall 12' which is opposite the endwall 14'. The carton construction shown in FIGS. 15 and 16, except for the provision of the tear strips 24A' and 24B', is shown in U.S. Pat. No. 4,572,422 and is known in the art.

The characteristics and advantages of the invention have been set forth in the foregoing description, together with the details of the carton structure and method of the invention, and the novel features thereof are set forth in the appended claims. This disclosure, however, is illustrative only, and changes may be made in the details thereof, especially matters of shape, size and arrangement of parts, within the principles of the invention to the full extent extended by the broad general meaning of the terms in which the appended claims are expressed. For example, liner L may be made of a transluscent as well as a transparent material, the important requirement being that the liner material is light transmitting so that the user can view the product therethrough to determine the amount of product remaining in the carton. A typical suitable liner material is a 48 gauge polyester/adhesive/3MIL LLDPE material.

What is claimed is:

1. A lined carton having a top and a boxed-shaped configuration and including an outer carton and a liner secured within said outer carton defining an interior of the carton, said outer carton having an upper and a lower end and including a pair of opposing sidewalls and a pair of opposing endwalls, said side-walls and said endwalls having upper and lower ends and interior surfaces facing the interior of said carton, said outer carton including top closure flaps formed at the upper end thereof, said liner being made of a see-through material and being constructed and arranged to extend along the interior surfaces of said sidewalls and said endwalls to define an enclosed interior of the carton, said carton comprising means for providing windows in one of said endwalls of said outer carton through which the interior of the carton is visible through said see-through liner, said window providing means comprising a pair of tear strips formed in one of said endwalls of said outer carton to extend along said one endwall in the direction between the upper and lower ends thereof and adapted to be removable to provide a pair of windows, means for securing said liner to the inner surface of said one endwall, said liner securing means comprising a pair of adhesive strips located to extend along opposite sides of each of said tear strips closely adjacent to said tear strips throughout the length of said tear strips to secure said liner against the inner surface of said one endwall so that said liner extends across said tear strips to closely overlie the same, and means for securing said liner to the inner surface of said other endwall opposite said one endwall, said last-named liner securing means comprising a third adhesive strip located to extend along said other endwall in the direction between the upper and lower ends thereof to secure said liner against the inner surface of said other endwall.

2. A carton according to claim 1 wherein said tear strips extend in a line along said one endwall and said adhesive strips are parallel to one another and extend substantially throughout the entire extent of said one endwall between said upper and lower ends thereof.

3. A carton according to claim 2 wherein said third adhesive strip comprises a wide adhesive strip for securing the liner against the inner surface of the other endwall opposite said one endwall, said wide adhesive strip extending throughout substantially the entire inner surface of said outer endwall.

4. A carton according to claim 2 including dispensing means comprising a pour spout formed in said outer carton at a location near the upper end thereof.

5. A carton according to claim 2 including a tear strip formed in one of said top closure flaps for use in opening the top of the carton.

6. A carton according to claim 2 including a thumb notch structure formed in the upper end of said other endwall for use in opening the top of the carton.

* * * * *